United States Patent [19]

Abou-Aly et al.

[11] Patent Number: 4,816,192

[45] Date of Patent: Mar. 28, 1989

[54] PORTABLE HANDHELD MOTOR-DRIVEN TOOL

[75] Inventors: Mohamed Abou-Aly, Waiblingen-Hegnach; Eberhard Bohnacker, Waiblingen; Bernhard Kiefel, Schorndorf; Reinhard Gerhardy, Korb; Reinhard Friedrich, Waiblingen; Erich Krauter, Winnenden-Birkmannsweiler, all of Fed. Rep. of Germany

[73] Assignee: Andreas Stihl, Waiblingen, Fed. Rep. of Germany

[21] Appl. No.: 123,149

[22] Filed: Nov. 20, 1987

[30] Foreign Application Priority Data

Nov. 25, 1986 [DE] Fed. Rep. of Germany ... 8631523[U]

[51] Int. Cl.[4] ..... F02M 15/04

[52] U.S. Cl. ..... 261/130; 261/131; 261/142; 261/DIG. 20

[58] Field of Search ..... 261/DIG. 20, 142, 130, 261/131

[56] References Cited

U.S. PATENT DOCUMENTS

| | | | |
|---|---|---|---|
| 1,931,875 | 10/1933 | Oppenheim | 261/142 |
| 2,941,061 | 6/1960 | Bowers | 261/DIG. 20 |
| 4,368,380 | 1/1983 | Igashira et al. | 261/142 |
| 4,377,148 | 3/1983 | Ishida | 261/142 |
| 4,389,354 | 6/1983 | Endou et al. | 261/DIG. 20 |
| 4,463,737 | 8/1984 | Berg et al. | 261/DIG. 20 |
| 4,717,808 | 1/1988 | Cyll et al. | 261/142 |

FOREIGN PATENT DOCUMENTS

| | | | |
|---|---|---|---|
| 690362 | 9/1930 | France | 261/142 |
| 61-145349 | 7/1986 | Japan | 261/DIG. 20 |

OTHER PUBLICATIONS

Kahr, Der Kaltleiter, Siemens Components, 23, (1985), vol. 4, pp. 152–157.

*Primary Examiner*—Tim Miles
*Attorney, Agent, or Firm*—Walter Ottesen

[57] ABSTRACT

The invention is directed to a handheld, portable tool such as a chain saw equipped with an internal combustion engine mounted in an engine housing. The engine has a carburetor defining an air-intake channel. A heating element is provided which is electrically connected to the generator of the chain saw and mounted on the carburetor in the region of the air-intake channel. The heating element has a positive temperature coefficient and a predetermined temperature region thereby preventing the carburetor housing and the throttle flap from heating to a temperature above a predetermined value. The heating element and the way it is mounted prevents icing at the carburetor in cold weather thereby enabling the engine to run uninterruptedly and uniformly especially when the engine idles.

9 Claims, 4 Drawing Sheets

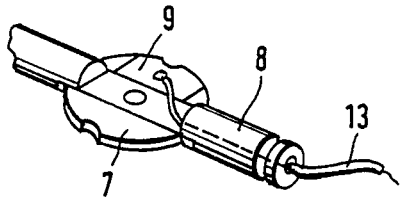
FIG.7
FIG.8
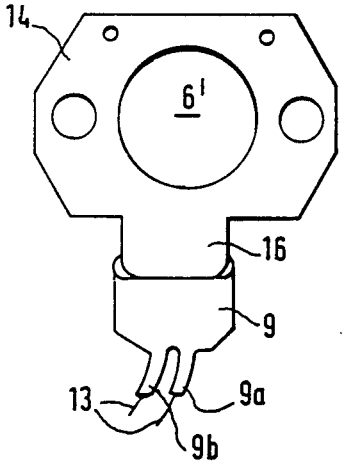
FIG.9
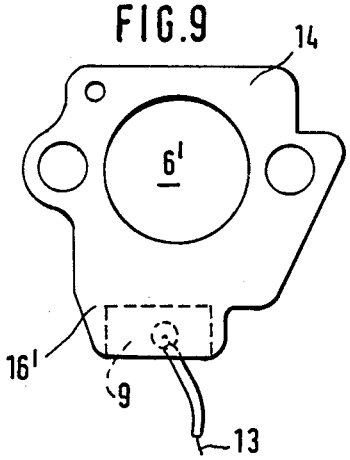
FIG.10
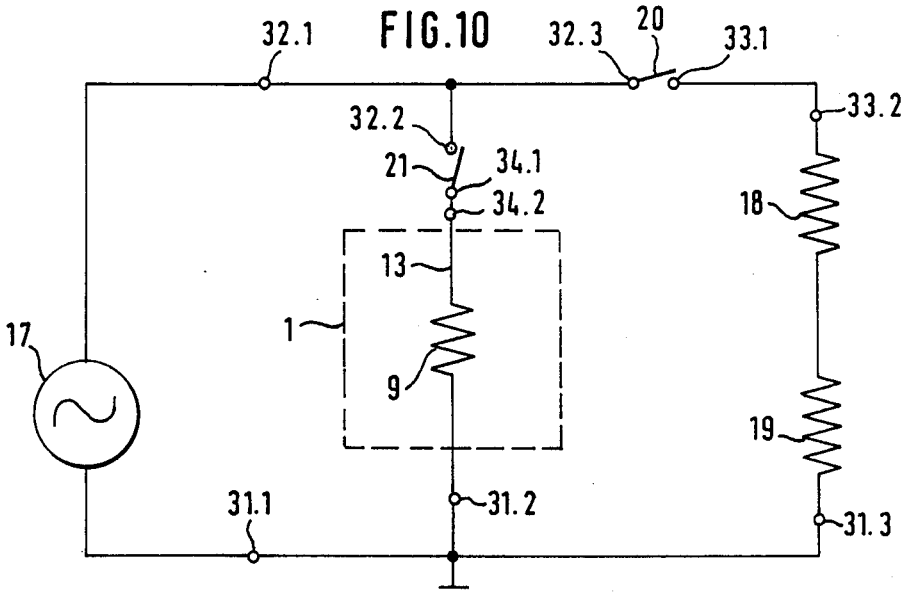

PORTABLE HANDHELD MOTOR-DRIVEN TOOL

FIELD OF THE INVENTION

The invention relates to a handheld portable motor-driven tool such as a motor-driven chain saw equipped with an internal combustion engine. The engine includes a carburetor with an air-intake channel and a throttle flap which is journalled in the housing of the carburetor. The handheld portable tool also includes a generator driven by the engine for generating a heating current.

BACKGROUND OF THE INVENTION

If such chain saws are utilized in cold weather, there is the danger that the moisture drawn in with the cold air condenses in the region of the air intake channel and especially on the throttle flap of the carburetor to form ice on the throttle flap. During idle, the engine will run unevenly as a consequence of this icing condition. This can cause the engine to come to an unwanted standstill thereby disrupting work being conducted with the chain saw. On the other hand, the idle speed of the engine can suddenly increase so far that the centrifugal clutch engages and the saw chain is suddenly and unexpectly set in motion and this can cause work accidents. Furthermore, icing of the carburetor can cause the maximum permissible speed of the engine and the permissible temperature to become exceeded which causes premature wear.

In known chain saws, these dangers and disadvantages are prevented by returning a portion of the heated air given off by the engine to prewarm the air inducted into the engine; however, other disadvantages must then be accepted. The inducted air heated by the engine entrains additional moisture and dirt during operation and sometimes snow so that operating disturbances can again occur and an increased maintenance effort with respect to the cleaning of the filter is then needed. Also, a substantial constructive effort is necessary for feeding the warm air back into the air intake channel.

SUMMARY OF THE INVENTION

It is an object of the invention to provide a handheld portable tool with a heating arrangement for protecting the region of the carburetor which is endangered by the icing. It is another object of the invention to provide such a handheld portable motor-driven tool which provides this protection and yet does not increase significantly the cost of manufacturing the tool and does not cause any noticeable accumulation of dirt.

The handheld portable tool according to the invention includes: an engine housing; an internal combustion engine mounted in the engine housing and having a carburetor; the carburetor having a carburetor housing defining an air-intake channel and having a throttle flap rotatably mounted in the channel; a generator driven by the engine for generating a heating current; and, an electric heating element electrically connected to the generator and mounted on the carburetor in the region of the air intake channel. The heating element is configured to have a positive temperature coefficient at a predetermined temperature region thereby preventing the carburetor housing and the throttle flap from heating to a temperature above a predetermined value. The heating element is further configured to be a flat member having a flat side in heat-conductive contact engagement with the carburetor.

The arrangement of the electric heating element requires only a slight constructive and manufacturing effort especially since the heating energy is delivered by the generator of the portable tool which provides a current supply for the heating resistors which are mounted on the handles of the chain saw. The selection of a heating element with a positive temperature coefficient in a predetermined temperature region provides a self-acting regulation of its resistance. Thus, when this predetermined temperature region is reached, the electrical resistance increases to such an extent that the current and therefore the heating capacity reduces to near zero. In this way, a heating of the carburetor housing and of the throttle flap to a temperature noticeably higher than said predetermined value is prevented which is desirable to ensure reliable operation by preventing the fuel from becoming overheated.

The heating element with a positive temperature coefficient is known as a PTC (positive temperature coefficient) device which is made of a doped polycrystalline ceramic and is configured as a flat member. The heating element can be connected with a carburetor part such as the carburetor housing or the throttle flap. A good heat transfer from the surface of the heating element to the part of the carburetor to be heated is assured by means of the heat-conductive connection of the one flat side of the heating element with the carburetor part.

BRIEF DESCRIPTION OF THE DRAWINGS

The invention will now be described with reference to the drawing wherein:

FIG. 7 is a perspective view showing the heating element mounted on the throttle flap of the carburetor;

FIG. 8 shows the heating element and an attachment plate for mounting the heating element on the carburetor of the chain saw;

FIG. 9 is another view of the heating element with the attachment plate pursuant to another embodiment of the invention;

FIG. 10 is a schematic circuit diagram for the electric heating arrangement of the motor-driven chain saw;

DESCRIPTION OF THE PREFERRED EMBODIMENTS OF THE INVENTION

Figure 1:
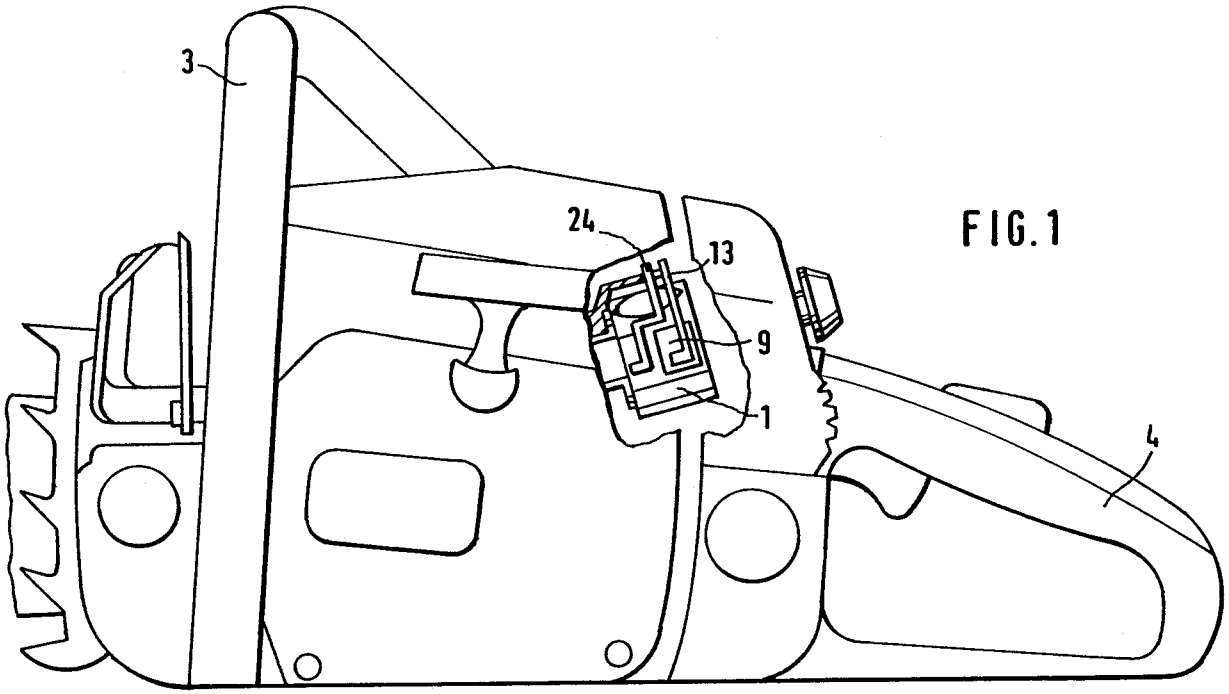
FIG. 1 is a side elevation view of a motor-driven chain saw with a portion of a housing cut away to show the arrangement of the heating element on the carburetor.

FIG. 1 is a schematic of a motor-driven chain saw having a forward handle 3 and a rearward handle 4. A portion of the housing is cut away to schematically show a membrane carburetor 1 mounted inside the carburetor enclosure 1*a* of the engine housing. An electrical heating element 9 is flat-mounted on the carburetor housing and is held in place with an adhesive. An electrical lead 24 runs to ground and a second conductor 13 is connected to the heating element 9 and to a generator (not shown in FIG. 1) of the chain saw.

Figure 2:
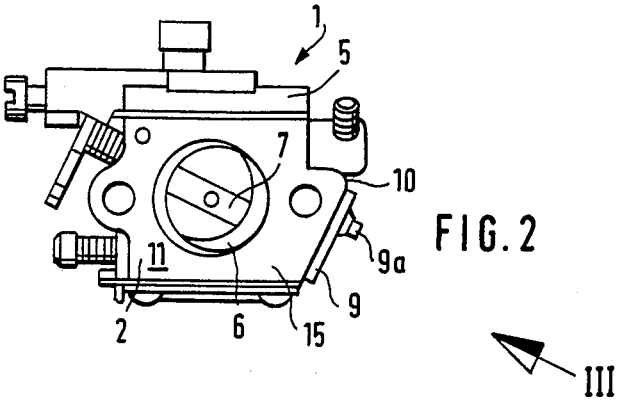
FIG. 2 shows the carburetor of the engine of the chain saw and the electric heating element mounted on the carburetor pursuant to one embodiment of the invention.

The membrane carburetor 1 is schematically shown in FIG. 2 and has a housing 2 covered by an upper cover 5. The carburetor 1 includes an air-intake channel 6 in which a throttle flap 7 is disposed. The throttle flap 7 is rotatably journalled in the housing 2.

Figure 3:
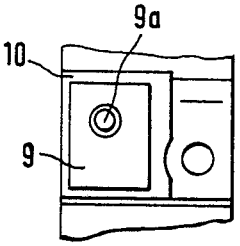
FIG. 3 is a view of the carburetor of FIG. 2 as seen in the direction of arrow III.

An electrical heating element 9 is mounted on the housing 2 of the carburetor. In the embodiment of FIGS. 2 and 3, the heating element is attached to an end surface 10 of the housing wall 11. However, the heating element 9 can be mounted to other wall parts of the housing. The heating element 9 is a self-regulating electrical resistor and is known as a PTC device. Thus, the heating element 9 has a positive temperature coefficient so that when current flows therethrough, it will not warm beyond a predetermined temperature limit. Such PTC devices are described in the technical paper by Werner Kahr entitled "Der Kaltleiter" published in Siemens Components 23 (1985), Volume 4, pages 152 to 157.

This heating element 9 is connected with its terminal 9*a* via a lead to a generator provided in the chain saw and is so configured that it becomes very highly resistive at a predetermined temperature to prevent an overheating of the housing. At lower temperatures, the heating element defines a heating resistance through which current flows. To ensure a good heat transfer to the housing wall, the PTC device 9 is configured as a thin platelet and lies flat on the housing wall 11. The PTC device transforms electrical energy into heat energy and affords the advantage that it generates a large amount of heat per unit area which substantially lessens the amount of space needed to accommodate the PTC device. For example, it will be shown below in connection with FIG. 7 that the PTC device can be mounted on the throttle flap of the carburetor and here generate enough heat to warm the temperature of the air drawn into the carburetor to prevent icing.

Several heating elements 9 can be provided depending upon the configuration of the carburetor 1. The heating elements 9 can be connected in parallel or in series via electrical leads and can be mounted on various sides of the carburetor 1 in order to ensure the desired temperature in the region of the throttle flap 7 and thereby prevent icing. It can be desirable to mount the heating element 9 on the inner surface of the carburetor housing 2 in dependence upon the particular configuration of the carburetor.

Figure 4:
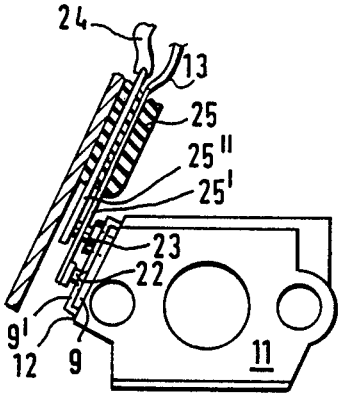
FIG. 4 is a side elevation view of the carburetor of FIG. 2 with the heating element mounted according to another embodiment of the invention.
Figure 5:
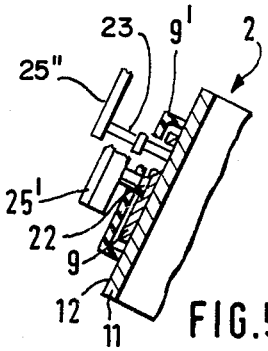
FIG. 5 is a cutaway portion of the carburetor of FIG. 4, partially in section and shows a contact arrangement for the contact members which establish electrical contact with the heating element.

In the embodiment according to FIGS. 4 and 5, the electric heating element 9 is configured as a flat member as in the embodiments according to FIGS. 2 and 3 and is attached by means of an adhesive to an end surface of the wall of the carburetor housing 2. An adhesive containing plastic is utilized for attaching the heating element 9 to the end surface 12 of the housing wall 11 and is insensitive to higher temperatures. This plastic adhesive is preferably electrically conductive so that it establishes the ground connection of the heating element with the housing of the carburetor. An adhesive suitable for this purpose is known commercially under the name ABLEBOND-84-1 LMI (electrically conductive) manufactured by Teltec GmbH of 7173 Mainhardt-Hütten, Federal Republic of Germany.

In the embodiment of FIGS. 4 and 5, the heating element is also electrically insulated to the outside by an insulating cap 9′ made of plastic or rubber by means of which a protection against moisture is provided.

A contact piece is electrically connected with the heating element 9 to provide a connection to the positive pole of the voltage source which here can be the generator (not illustrated) of the chain saw itself. In the embodiment of FIGS. 4 and 5, this contact piece is in the form of a rivet 22 which penetrates the insulating cap 9′ with its shaft portion and is attached to the tongue of a contact metal strip 25′. The contact strip 25′ and a contact metal strip 25″ are arranged in parallel and are both embedded in a plastic housing 25 which serves as a contact carrier. The contact strip 25″ likewise defines a contact tongue at its outer end which carries a contact piece 23 which is in contact engagement with the carburetor housing 2 so as to define a ground connection. This connection can be seen in FIG. 5 wherein a portion of the heating element 9 and a portion of the insulating cap 9′ have been broken away to show contact piece 23 in contact engagement with housing wall 11 of the carburetor housing 2. An electric lead 24 extends from contact strip 25″ to a ground point of the housing of the chain saw. The contact metal strip 25′ is connected to an electrical conductor 13 which leads to the generator or to a switch and is switched in dependence upon the ambient temperature and is connected with the positive output of the generator. A constructive adaptation of these parts to the particular structural configuration of a carburetor is easily possible since the heating element 9 and the contact carrier 25 are configured as separate components.

Figure 6:
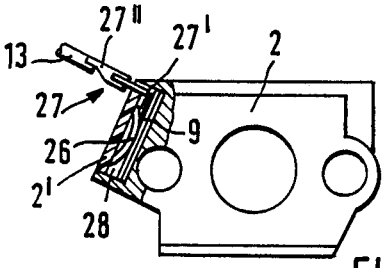
FIG. 6 is a side elevation view of the carburetor showing another embodiment of the contact arrangement for the heating element.

FIG. 6 is another variation of the embodiment according to FIGS. 4 and 5. Here, the heating element 9 is seated in a recess 28 of the carburetor housing. A flat prebent contact spring 26 is provided to establish contact between current conducting lead 13 and the heating element 9. This contact spring is likewise accommodated in the recess 28 and is pressed against the heating element 9 by means of a cover 2′ which closes off the recess 28. The cover 2′ is part of the carburetor housing 2. The contact spring 26 can be held in the cover made of plastic, for example. For establishing contact, a plug connection 27 is provided which comprises a tongue 27′ passing through the cover 2′ and a connector 27″ which is connected to a supply lead 13 coming from the generator. The tongue 27′ can also be configured as one piece with the prebent contact spring 26. In this embodiment, the heating element in the recess 28 is electrically insulated with respect to the remaining parts of the carburetor and is mounted so as to be protected against moisture and therefore does not require any special insulating covering.

A further advantageous heating effect is obtained if the heating element 9 is mounted directly on the throttle flap 7 of the carburetor 1 as shown in FIG. 7. In this way, the air can be warmed directly within the air-intake channel 6 (see also FIG. 2). A supply lead 13 is passed through the shaft 8 with which the throttle flap 7 is pivotally journalled in the carburetor housing. This configuration makes the leads for the current supply as independent as possible from the movements of the throttle flap 7. The lead 13 is brought out from the shaft 8 at the attachment location of the throttle flap 7 and is soldered to the terminal of the heating element 9. The lead 13 is insulated and flexible and the location on the shaft 8 whereat it is brought out of the shaft is flattened as shown in FIG. 7.

FIGS. 8 and 9 show two variations of another embodiment of the invention wherein the heating element 9 is mounted on a heat-conducting plate 14. The plate 14 is adapted in its form to the carburetor housing 2 (compare FIG. 9 to FIG. 2) and is attached in flat contact engagement with the side wall 15 of this housing 2. The plate can be made of copper, aluminum or a similar material having a high heat-conductivity.

A center opening 6' of the plate 14 corresponds to the opening of the air-intake channel 6 (FIG. 2) so that the entry of the air to the channel is unhindered by the plate 14. Furthermore, the plate 14 has attachment holes which correspond to bores of the housing wall 15. In the embodiment of FIG. 8, the heating element 9 can be configured like a sleeve or have bent-over side edges and pushed onto a projection 16 of the plate 14. An adhesive or solder connection can be provided for attaching the heating element 9. The heating element 9 has two terminals **9*a* and 9*b* of which one terminal is connected to the positive generator output and the other terminal is connected to ground for which two leads 13** are provided.

The plate 14 of FIG. 9 likewise has a projection 16' which is however shorter. The heating element 9 lies flat on the inner side of the projection 16' which faces toward the carburetor housing 2 and is there attached by means of an adhesive. This connection corresponds to the embodiment of FIGS. 2 and 3.

FIG. 10 shows the circuit arrangement for heating. The heating element 9 attached to the carburetor 1 is supplied with current from a generator 17 of the chain saw. In addition, two heating resistors 18 and 19 are connected in series and are connected to the generator via a switch 20. The heating resistors 18 and 19 are provided in the forward handle 3 and in the rearward handle 4, respectively, of the saw shown in FIG. 1. This heating of the handles is known and therefore requires no further description.

The supply lead 13 of the heating element 9 is connected to the generator 17 via a switch 21. The heating element 9 can be a PTC device manufactured by Siemens AG having a product number LN 85/172. However, this device has a positive temperature coefficient in the predetermined temperature region of 40° C. Thus, it is only at this temperature that the current and therefore the heating capacity reduces to zero. Because an air temperature of 40° C. would make the air/fuel mixture supplied to the engine too hot, a thermoswitch 21 is provided which opens at a temperature 18° C.±2° C. thereby allowing the heating element 9 to heat the air/fuel mixture to only this temperature thereby preventing the air/fuel mixture drawn into the carburetor from becoming too hot. The thermoswitch 21 is preferably mounted in the vicinity of the carburetor housing and within the carburetor enclosure **1*a* (FIG. 1**) of the engine housing.

The two heating current loops for the heating of the air supplied to the carburetor housing 2 on the one hand and for the handles 3 and 4 on the other hand are connected in parallel and can therefore be switched in and out independently of each other.

Figure 11:
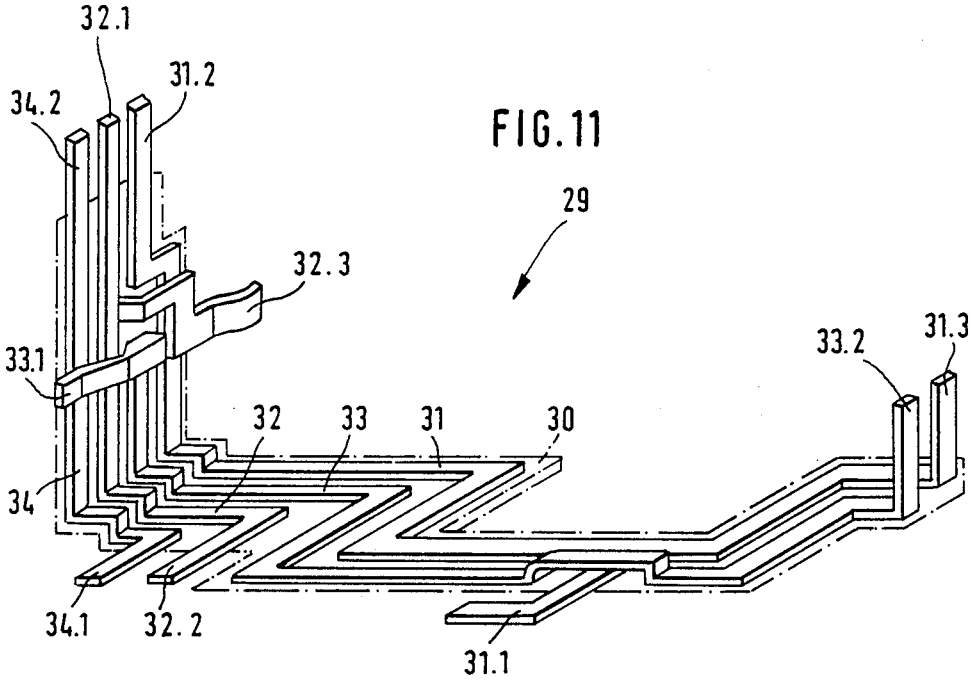
FIG. 11 shows the electrical conductors for the circuit arrangement according to FIG. 10 as a component part; and, FIG. 12 is a perspective view of the component of FIG. 11 in the form of a synthetic block with contact tongues brought out of the plastic block.
Figure 12:
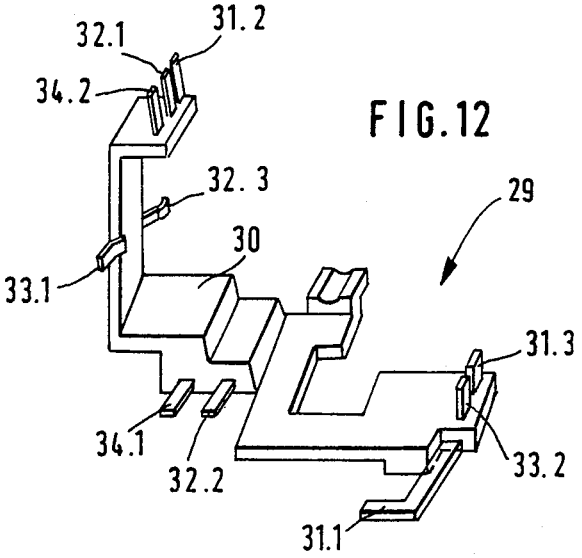

As already mentioned in connection with FIGS. 4 and 5, the electrical leads for the connection to the switching elements can be embedded in plastic. FIGS. 11 and 12 show a component 29 with several conductor paths 31, 32, 33 and 34 which are embedded in a plastic block 30. This plastic block 30 is adapted to the inner dimensions of the housing of the chain saw and can therefore be simply seated in the housing. The contact tongues extend outwardly beyond the block 30 and are disposed directly in the vicinity of the corresponding connections to the electrical components. The designation of the contact tongues corresponds with the numbering of the connections in FIG. 10. The conductor 31 which is to be connected to ground therefore has three contact tongues 31.1, 31.2 and 31.3 which correspond to the ground connections of the generator 17, the heating element 9 and the heating resistor 19, respectively. The current supply lead 13 for the heating element 9 is connected to the contact tongue 34.2 of the conductor 34. The one contact of the switch 21 is connected to the other contact tongue 34.1 of the conductor 34. The correspondence of the contact tongues 32.1, 32.2 and 32.3 of the conductor 32 to the connections of the generator 17 and the switches 20 and 21 is likewise shown in FIG. 10 as is the correspondence of the contact tongues 33.1 and 33.2 of the conductor 33 to the corresponding connections of the switch 20 and of the heating resistor 18.

Wiring by means of a cable harness is avoided by means of the constructive assembly of the electrical conductor to such a contact assembly whereby the assembly is simplified and the operational reliability is increased.

The essential advantage of the heating of the carburetor housing pursuant to the invention is that an improved idle performance of the chain saw is achieved. This is true because also at low ambient temperatures, there is no danger of icing at the carburetor and the internal combustion engine can always run uniformly and uninterruptedly after starting so long as the engine is running. Additional components to provide preheating of the intake air are unnecessary insofar that work under extreme weather conditions is not necessary and for which the electrical heating via the PTC device alone could be insufficient. Since special measures for preheating the intake air are unnecessary at outside temperatures which are not too low, a dirtying in the carburetor housing is substantially avoided whereby longer maintenance intervals are achieved, fewer operational disturbances are experienced and a lower wear of the chain saw is obtained.

It is understood that the foregoing description is that of the preferred embodiments of the invention and that various changes and modifications may be made thereto without departing from the spirit and scope of the invention as defined in the appended claims.

What is claimed is:

1. A handheld, portable tool comprising:

an engine housing;

an internal combustion engine mounted in said engine housing and having a membrane carburetor;

said carburetor including a carburetor housing having a housing wall defining an air-intake channel and, a throttle flap rotatably mounted in said channel;

a generator driven by said engine for generating a heating current;

an electric heating element electrically connected to said generator and mounted on said carburetor in the region of said air-intake channel;

said heating element having a positive temperature coefficient at a predetermined temperature region thereby preventing said carburetor housing and said throttle flap from heating to temperature above a predetermined value; and, said heating element being further configured to be a flat member having a flat side and being attached directly to said housing wall so as to cause said flat side to be in heat-conductive contact with said housing wall over the entire surface of said flat side to permit a direct transfer of heat from said heating element through said wall and into said air-intake channel;

said engine housing having a ground terminal; and, a contact arrangement for said heating element, said contact arrangement including: a contact carrier for carrying a first contact member electrically connected to said generator; and, a second contact member connected to said ground terminal; said first contact member including first contact means for electrically connecting said first contact member to said heating element; and, said second contact member including second contact means for connecting said second contact member to said carburetor housing.

2. The handheld, portable tool of claim 1, wherein said predetermined temperature region is in the vicinity of 20° C.

3. The handheld, portable tool of claim 1, further comprising a thermoswitch connected into the circuit defined by said electric heating element and generator to interrupt the supply of current to said heating element when the temperature in said carburetor enclosure rises to a second predetermined temperature less than said first predetermined temperature thereby preventing said carburetor housing and said throttle flap from heating to a temperature above said second predetermined temperature.

4. A handheld, portable tool comprising:

an engine housing;

an internal combustion engine mounted in said engine housing and having a carburetor;

said carburetor having a carburetor housing defining an air-intake channel and having a throttle flap rotatably mounted in said channel;

a generator driven by said engine for generating a heating current;

an electric heating element electrically connected to said generator;

said heating element having a positive temperature coefficient at a predetermined temperature region thereby preventing said carburetor housing and said throttle flap from heating to temperature above a predetermined value;

said heating element being further configured to have a flat side;

said throttle flap having a flat side; and, said heating element being attached to said throttle flap so as to cause said flat side of said heating element to be in heat-conductive contact engagement with said flat side of said throttle flap.

5. The handheld, portable tool of claim 4, said throttle flap having a shaft for pivotally mounting said throttle flap in said air-intake channel; said shaft having an axial bore formed therein and communicating with said heating element; said portable tool further comprising a lead extending from said generator and passing through said bore and connected to said heating element.

6. The handheld, portable tool of claim 4, said heating element being attached to said throttle flap by means of a heat-resistant adhesive manufactured from a plastic base material.

7. The handheld, portable tool of claim 4, further comprising additional ones of said heating elements mounted at various locations on said carburetor housing.

8. The handheld, portable tool of claim 4, further comprising a thermoswitch connected into the circuit defined by said electric heating element and said generator to interrupt the supply of current to said heating element when the temperature in said carburetor enclosure rises to a second predetermined temperature less than said first predetermined temperature thereby preventing said carburetor housing and said throttle flap from heating to a temperature above said second predetermined temperature.

9. A handheld, portable tool comprising:

an engine housing;

an internal combustion engine mounted in said engine housing and having carburetor;

said carburetor having a carburetor housing defining an air-intake channel and having a throttle flap rotatably moutned in said channel;

a generator driven by said engine for generating a heating current;

an electric heating element electrically connected to said generator and mounted on said carburetor in the region of said air-intake channel;

said heating element having a positive temperature coefficient at a predetermined temperature region thereby preventing said carburetor housing and said throttle flap from heating to temperature above a predetermined value;

said heating element being further configured to be a flat member having a flat side in heat-conductive contact with said carburetor; and, a plastic block; a plurality of electrical components having respective terminals; and, a plurality of electrical conducting paths for electrically connecting said components and said heating element to said generator, said electrical conducting paths being embedded in said plastic block to conjointly define a component block therewith; and, said conducting paths having respective ends defining contact tongues extending from said block for providing an electrical connection to said heating element and said electrical components.

* * * * *